US007204107B2

(12) United States Patent
Leyden et al.

(10) Patent No.: US 7,204,107 B2
(45) Date of Patent: Apr. 17, 2007

(54) ADJUSTABLE TETHERING SYSTEM FOR SECURING AN ARTICLE

(75) Inventors: Roger Leyden, Willow Springs, IL (US); Bjarne Frederiksen, Lombard, IL (US); Terrance Surma, Bloomingdale, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 67 days.

(21) Appl. No.: 10/927,548

(22) Filed: Aug. 26, 2004

(65) Prior Publication Data

US 2006/0045613 A1 Mar. 2, 2006

(51) Int. Cl.
*E05B 73/00* (2006.01)

(52) U.S. Cl. ..... 70/18; 70/58

(58) Field of Classification Search ..... 70/30, 70/49, 18, 58, 14, 259, 260; 24/115 H, 135 N; 248/551–553; 292/307 R, 308, 315, 319
See application file for complete search history.

(56) References Cited

U.S. PATENT DOCUMENTS 289,334 A * 11/1883 Brewer ..... 24/135 N
351,063 A * 10/1886 McCormick ..... 70/65
1,273,922 A * 7/1918 Prattinger ..... 24/135 N
1,520,902 A 12/1924 Junkunc
2,163,660 A * 6/1939 Brooks ..... 292/308
3,585,823 A * 6/1971 Nagel ..... 70/49
3,728,879 A * 4/1973 Best ..... 70/38 R
3,841,118 A * 10/1974 Stone ..... 70/33
3,987,653 A 10/1976 Lyon et al.
4,212,175 A 7/1980 Zakow
4,342,477 A 8/1982 McClure
4,455,464 A 6/1984 Leyden
4,623,338 A 11/1986 Larson
4,869,084 A 9/1989 Mack, Jr.
4,955,750 A * 9/1990 Goran ..... 403/306
4,986,457 A 1/1991 Faris
5,154,072 A 10/1992 Leyden
5,172,098 A 12/1992 Leyden et al.
D335,439 S 5/1993 Leyden et al.
5,279,135 A 1/1994 Leyden et al.
D345,092 S 3/1994 Leyden et al.
5,341,124 A 8/1994 Leyden et al.
5,351,507 A 10/1994 Derman
5,421,667 A 6/1995 Leyden et al.
5,473,917 A * 12/1995 Say ..... 70/49
5,552,771 A 9/1996 Leyden et al.

(Continued)

*Primary Examiner*—Lloyd A. Gall
(74) *Attorney, Agent, or Firm*—Wood, Phillips, Katz, Clark & Mortimer

(57) ABSTRACT

A tethering system having an elongate flexible element, with a length, and an anchoring system. The anchoring system has a block defining first and second surfaces. The anchoring system further includes (a) a first anchoring assembly for bearing a first portion of the elongate flexible element against the first surface with the first anchoring assembly in a first state to maintain the first portion of the elongate flexible element substantially fixed against movement relative to the first surface, and (b) a second anchoring assembly for bearing a second portion of the elongate flexible element against the second surface. The first anchoring assembly is changeable selectively between its first state and a second state wherein the first portion of the elongate flexible element can move relative to the first surface to allow the elongate flexible element to be formed into a loop with a variable diameter.

24 Claims, 5 Drawing Sheets

U.S. PATENT DOCUMENTS 5,565,848 A 10/1996 Leyden et al.
5,577,855 A 11/1996 Leyden et al.
5,246,183 A 6/1997 Leyden et al.
5,676,258 A 10/1997 Leyden et al.
5,706,679 A 1/1998 Zane et al.
5,733,083 A * 3/1998 Heminger ..... 411/82
5,743,574 A 4/1998 Kohn
5,823,020 A 10/1998 Benda
5,829,280 A 11/1998 Chen
5,889,463 A * 3/1999 Judd et al. ..... 340/427
5,984,380 A 11/1999 Rice
6,003,348 A 12/1999 McCrea
6,039,498 A 3/2000 Leyden et al.
6,044,674 A * 4/2000 Rushing et al. ..... 70/232
6,087,939 A 7/2000 Leyden et al.
6,212,922 B1 4/2001 Miao
6,263,547 B1 7/2001 Andersson
RE37,590 E 3/2002 Leyden et al.
6,578,913 B2 * 6/2003 Wilhelm ..... 297/217.7
6,931,894 B2 * 8/2005 Yu ..... 70/18
7,021,091 B2 * 4/2006 Leyden et al. ..... 70/18
2004/0065126 A1 4/2004 Yang

* cited by examiner

ADJUSTABLE TETHERING SYSTEM FOR SECURING AN ARTICLE

BACKGROUND OF THE INVENTION

1. Field of the Invention

This invention relates to security systems for discrete articles and, more particularly, to a tethering system for connecting an article to be secured relative to a support.

2. Background Art

The overwhelming trend in designing point of purchase displays has been to make articles displayed thereat available to be picked up and operated by consumers. One can witness, at virtually any store at which electronics are sold, a wide range of articles that are conveniently displayed for trial. These articles vary considerably in terms of their size and configuration. At one end of the size spectrum are articles such as PDA's, cellular telephones, digital music players, etc. At the other end of the spectrum are televisions, which have been designed with increasingly greater picture areas and smaller housings. This electronic technology continues to evolve with new products of increasing sophistication regularly offered to consumers. These electronic products, by reason of their sophistication, are generally expensive in nature and an inviting target for thieves. The sophistication of thieves has presented to the security industry a substantial challenge to avoid the unauthorized removal of not only very compact articles, but even large articles, such as televisions.

The industry has responded to the theft challenge by developing security systems that range from basic mechanical systems to sophisticated electromechanical systems. One of the most common security systems utilizes a flexible tether that is connected between a support and an article to be secured. The tethers allow the associated article to be picked up, inspected, and potentially operated within a predetermined range, as dictated by the effective length of the tether. Toward the end of wire management, some systems utilize a tether that can be withdrawn into a housing. The Assignee herein currently offers products with this capability with both a purely mechanical tether and an electromechanical tether, as shown respectively in U.S. Pat. Nos. 5,246,183 and Re. 37,590.

One challenge to the security industry has been to devise an effective means for attaching the tether to the particular article that is being secured. One form of connection is what is termed a "lasso" connector formed using an elongate, flexible element. The elongate flexible element is formed into a restrictable loop. The "loop" may extend through a surrounded opening associated with the article, such as a finger opening around an operating trigger on a hand tool. Alternatively, the lasso can be restricted around a necked portion of an article, such as on a computer component, a television, or the like.

While the lasso connector has been widely used in several different forms in the security industry, purveyors thereof continue to seek out lasso designs that offer affordability, and ease of operation. Of course, the overall goal of these systems is that they be reliable once installed.

SUMMARY OF THE INVENTION

In one form, the invention is directed to a tethering system having an elongate flexible element, with a length, and an anchoring system. The anchoring system has a block defining first and second surfaces. The anchoring system further includes (a) a first anchoring assembly for bearing a first portion of the elongate flexible element against the first surface with the first anchoring assembly in a first state to maintain the first portion of the elongate flexible element substantially fixed against movement relative to the first surface, and (b) a second anchoring assembly for bearing a second portion of the elongate flexible element against the second surface with the second anchoring assembly in a first state to maintain the second portion of the elongate flexible element substantially fixed against movement relative to the second surface. The first anchoring assembly is changeable selectively between its first state and a second state wherein the first portion of the elongate flexible element can move relative to the first surface. The second anchoring assembly is changeable selectively between its first state and a second state wherein the second portion of the elongate flexible element can move relative to the second surface. The elongate flexible element is formable into a loop with a diameter between the first and second portions. The loop is maintainable in a selected diameter with the first and second anchoring assemblies in their first states. The diameter of the loop is variable by placing the first anchoring assembly in its second state and moving the first portion of the elongate flexible element relative to the first surface to produce a changed diameter for the loop. The first anchoring assembly is changeable from its second state into its first state to thereby maintain the changed diameter for the loop.

In one form, the block has first and second openings bounded respectively by the first and second surfaces.

The first and second openings may be fully spaced, each from the other.

The first and second openings may be defined by substantially parallel bores through the block.

In one form, the first surface has a sharp edge against which the first portion of the elongate flexible element is borne by the first anchoring assembly.

In one form, the first portion of the elongate flexible element has an outer surface into which the sharp corner digs with the first anchoring assembly in its first state.

In one form, the first anchoring assembly has a first anchoring element that is movable selectively towards and away from the first surface to thereby change the first anchoring assembly between its first and second states.

The first anchoring element may be threadably engaged with the block to be turnable around a first axis selectively in first and second opposite directions to thereby move the first anchoring element towards and away from the first surface.

In one form, the first anchoring element has a head that is engageable by a tool through which the first anchoring element can be turned around the first axis.

The head may have a receptacle for cooperating with a custom designed turning tool.

The anchoring assembly may include a second anchoring element that is movable selectively towards and away from the second surface to thereby change the second anchoring assembly between its first and second states.

In one form, the first anchoring element is movable along a first line in changing the first anchoring assembly between its first and second states. The second anchoring element is movable along a second line in changing the second anchoring assembly between its first and second states. The first and second lines may be substantially parallel.

In one form, the first and second lines are substantially coincident.

In one form, the block has a wall. The first surface is defined by the wall and faces in a first direction and the second surface is defined by the wall and faces oppositely to the first direction.

The first and second openings may be defined by spaced first and second bores through the block. The elongate flexible element in one form has a free end that can be directed fully through each of the first and second through bores.

In one form, the first bore has a first diameter, with the free end of the elongate flexible element having an enlargement thereon with a second diameter that is less than the first diameter. With the first anchoring assembly in its first state, the diameter of the first bore is effectively reduced to less than the second diameter.

The above elements may be provided in combination with a support to which a part of the elongate flexible element, spaced from the loop, is attached.

In one form, the elongate flexible element has a hardened metal core.

The above elements may be provided in combination with an article having a portion around which the loop extends and an alarm system for producing a detectable signal in the event that at least one of (a) an article is separated from the loop, (b) the elongate flexible element is separated from the support, and (c) the elongate flexible element is severed.

In one form, the block has a recess for accepting at least a portion of the head on the first anchoring element.

In one form, the head on the first anchoring element has a free end and the head has a truncated conical shape with a diameter that increases away from the free end of the head.

In one form, the block is made from a plastic material.

The block may have a cylindrical shape.

The invention is further directed to a method of forming a loop with a variable diameter in a flexible elongate element with a free end. The method includes the steps of: providing an anchoring system with a block defining first and second surfaces; placing a first portion of the elongate flexible element against the first surface and bearing the first portion of the elongate flexible element forcibly against the first surface with a first anchoring assembly; and placing a second portion of the elongate flexible element against the second surface so that a loop is formed between the first and second portions of the elongate flexible element and bearing the second portion of the elongate flexible element forcibly against the second surface with a second anchoring assembly that is operable independently of the first anchoring assembly.

In one form, the step of providing an anchoring system involves providing a block with spaced first and second through bores. The step of placing the first and second portions of the elongate flexible element against the first and second surfaces may involve directing the free end of the elongate flexible element into and through the first through bore and into and through the second through bore.

The step of bearing the first portion of the elongate flexible element against the first surface may involve directing a first anchoring element guidingly against the block into the first through bore to against the elongate flexible element.

The method may further include the step of directing the loop around an article to be secured using the elongate flexible element.

The method may further include the step of restricting the loop around a necked portion of the article.

The method may further include the step of directing the free end of the elongate flexible element through an opening in an article to be secured after the free end of the elongate flexible element is directed through the first bore and before the free end of the elongate flexible element is directed into the second through bore.

The method may further include the step of connecting a part of the elongate flexible element to a support relative to which the article is to be confined in movement by the elongate flexible element.

DETAILED DESCRIPTION OF THE DRAWINGS

Figure 1:
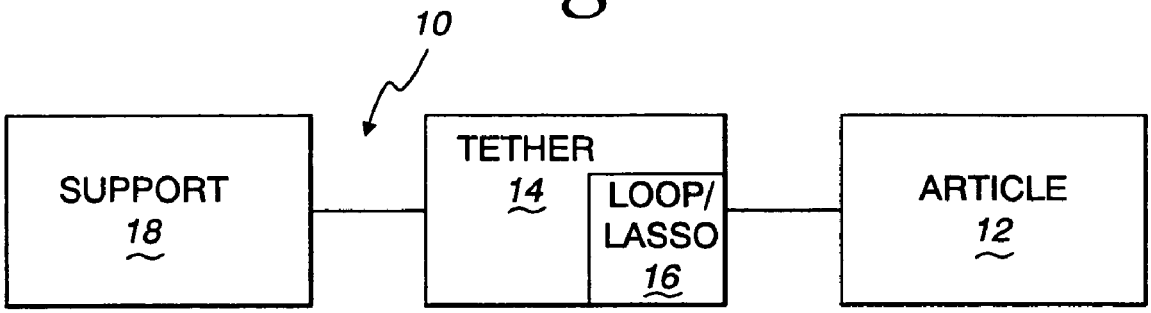
FIG. 1 is a schematic representation of an article and a security system, including a tethering system, according to the present invention, connected between the article and a support.

Referring initially to FIG. 1, a security system, according to the present invention, is shown at 10, for a discrete article 12. The article 12 may take virtually a limitless number of different forms. The security system 10 is particularly useful to be incorporated into point of purchase displays, such as those for portable electronic articles.

The security system 10 consists of an elongate flexible element 14, hereinafter referred to as a "tether", which is formable into a loop/lasso 16 in a manner to connect the same to the article 12, in a manner as hereinafter described. The tether 14 is in turn connected to a support 18. The length of the tether 14 between the article 12 and support 18 determines the range of movement of the article 12 relative to the support 18, as to permit its handling and inspection by a consumer. As is also explained in greater detail below, the tether 14 may be a purely mechanical tether, or may define a conductive path to be integrated into an electromechanical security system.

Figure 2:
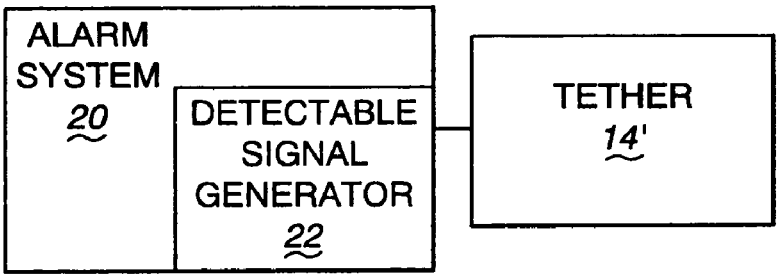
FIG. 2 is a schematic representation of an alarm system that can be used to detect, and alert an operator to, a breach of the security system in FIG. 1.

As shown in FIG. 2, a tether 14' defines a conductive path that is integrated into an alarm system 20. The alarm system 20 can be designed with a detectable signal generator 22 that generates a signal in the event that at least one of (a) the tether 14 is severed at some point between the support 18 and article 12, (b) the tether 14 is separated from the article 12, and (c) the tether 14 is separated from the support 18.

Generally, the nature of the support 18, and manner of connection of the tether 14 to the support 18, are not critical to the present invention. Further, the nature of the alarm system 20 is not limited to any specific configuration. Those skilled in the art are familiar with myriad different components and systems that would achieve the ends described herein. The present invention is focused specifically on the tether 14, and the manner of forming the loop/lasso 16 for use as part of any type of system, described generically above, and shown in FIGS. 1 and 2.

Figure 3:
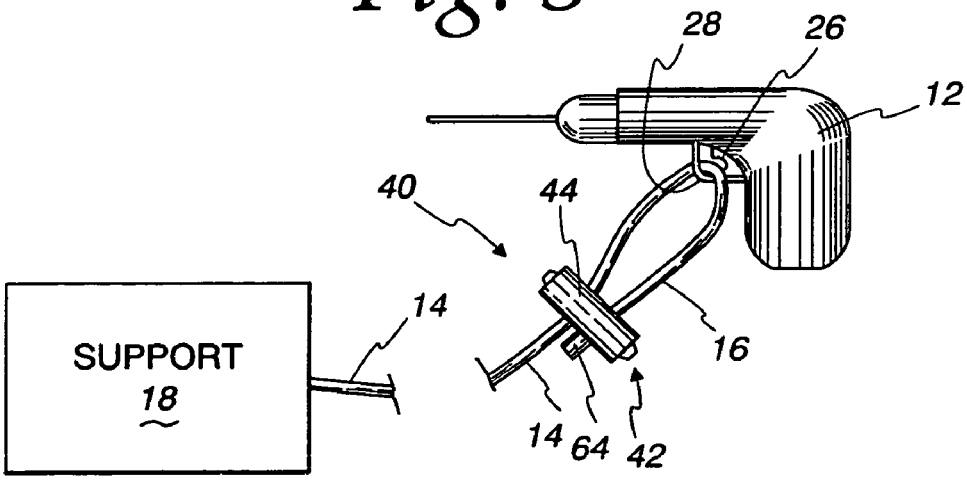
FIG. 3 is a partially schematic, side elevation view of the inventive security system, with the tethering system thereon, operatively connected to a portable hand drill.
Figure 4:
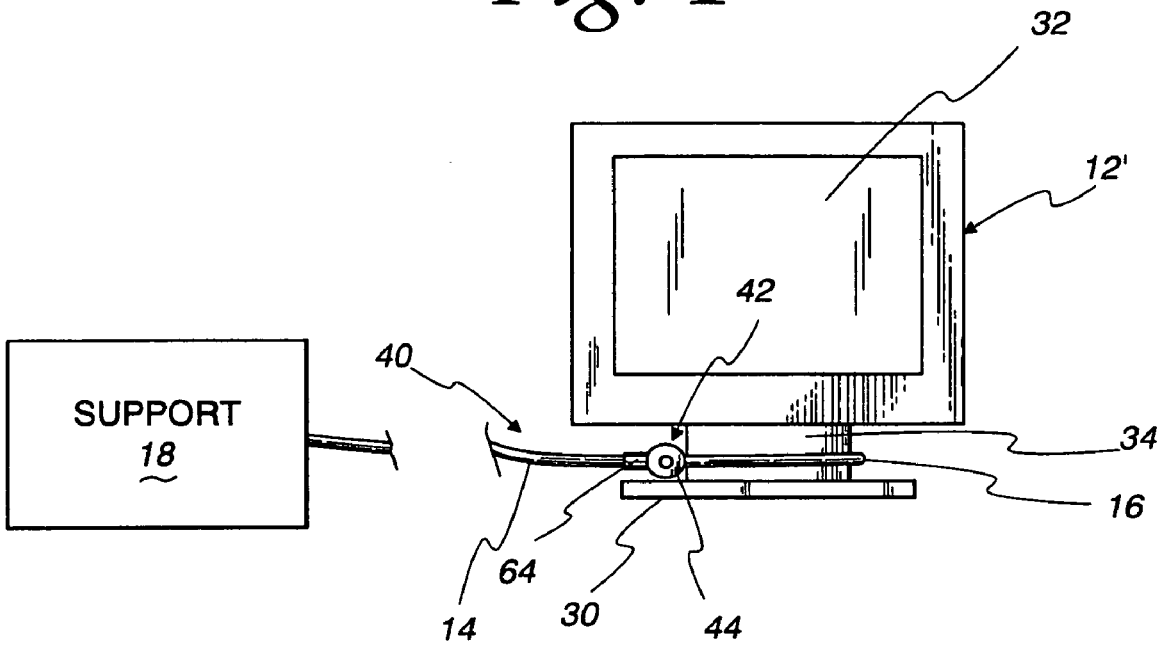
FIG. 4 is a view as in FIG. 3 with the tethering system operatively connected to an article that is in the form of a television or computer monitor.
Figure 5:
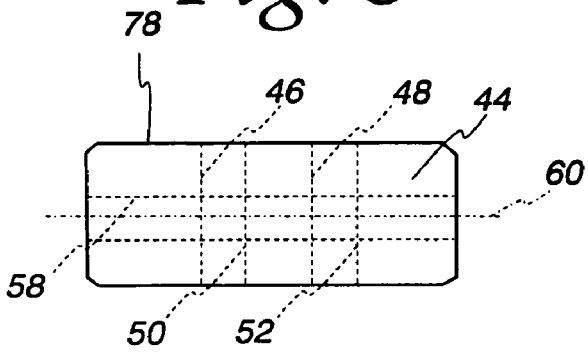
FIG. 5 is an enlarged, elevation view of a block on the inventive tethering system with which an elongate flexible element/tether on the tethering system cooperates to form a loop.

FIGS. 3 and 4 show two exemplary manners of using the tether 14. In FIG. 3, the tether 14 is shown attached to the support 18 and has a loop/lasso 16 that has an effective diameter. In FIG. 3, the loop 16 is extended through an opening 26 formed in part by a trigger guard 28 on a portable hand drill 12. The loop/lasso 16 will maintain the tether 14 operatively connected to the portable hand drill 30 so long as the loop/lasso 16 is closed, regardless of its diameter.

In FIG. 4, the tether 14 is operatively connected to an article at 12', in the form of either a television or computer monitor. The article 12' has a base 30 and a display portion 32 between which a necked portion 34 is formed. The loop/lasso 16 can be enlarged to be directed upwardly over the base 30, or downwardly over the display portion 32, to reside at the necked portion 34. By then reducing the diameter of the loop/lasso 16, the loop/lasso 16 can closely surround the necked portion 34. In this operative position, the loop/lasso 16 is restricted in diameter sufficiently that it cannot pass back over either the display portion 32 or base 30 to allow separation of the tether 14 from the article 12'.

As seen in FIGS. 5–13, the invention is directed to a tethering system at 40, consisting of the tether 14 and an anchoring system at 42 (see also FIGS. 3 and 4), for either (a) maintaining the loop/lasso 16 in a predetermined fixed diameter or (b) maintaining the loop/lasso 16 in any diameter in a particular range of diameters.

The anchoring system 42 consists of a block 44, in this case shown with a cylindrical shape. The block 44 has spaced, generally parallel, first and second through bores 46,48, bounded by first and second surfaces 50,52, respectively. The through bores 46,48 have central axes 54,56, respectively, which are spaced and substantially parallel to each other.

A through bore 58 is formed in the block 44, orthogonally to the through bores 46, 48, with the center of the through bore 58 coinciding with the central axis 60 for the cylindrical block 44. The axes 54, 56 each intersects the central axis 60. This is not a requirement, nor is the parallel relationship of the through bores 46, 48.

An optional fitting 64 is crimped to, or otherwise formed at, the free end 68 of the tether 14. The fitting 64 has a cylindrical shape with a diameter D (FIG. 8) that is less than the diameters D1 for the through bores 46,48. The fitting 64 can thus pass into and through each of the through bores 46,48.

To assemble the tether 14 to the block 44, the fitting 64 is introduced at one end 70 of the through bore 46 and directed through the through bore 46 and out of the opposite end 72. A sufficient length of the tether 14 is pulled through the bore 46 that it can be doubled back to allow the fitting 64 to be directed oppositely into an end 74 of the through bore 48. The fitting 64 is then directed through the through bore 48 and preferably, thought not necessarily, out through the opposite end 76 thereof to be exposed outside of the block 44. In this state, the tether 14 and external surface 78 of the block between the bores 46,48 cooperatively define the closed loop/lasso 16.

The effective diameter of the loop/lasso 16 can be selected by controlling the length of the tether 14 between the bore ends 72,74. The diameter can be restricted by drawing a first portion 80 of the tether 14 within the bore 46 through the bore in the direction of the arrow 82 in FIG. 10 and/or by drawing a second portion 84 of the tether 14 within the through bore 48 therethrough in the direction of the arrow 86. Opposite movement of one or both of the portions 80, 84 can be effected to enlarge the diameter of the loop/lasso 16.

Once the desired diameter for the loop/lasso 16 has been selected, the first and second tether portions 80,84, within the bores 46,48, are fixed therewithin. To accomplish this, a first anchoring assembly on the anchoring system 42 is provided at 88, with a second anchoring assembly provided at 90. The first anchoring assembly 88 includes a first anchoring element 92, with the second anchoring assembly including a second anchoring element 94.

Figure 6:
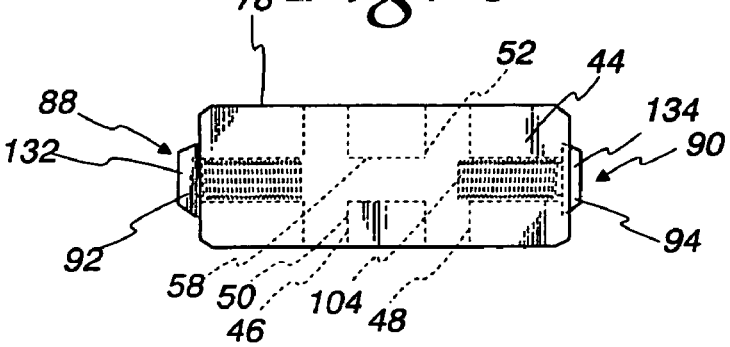
FIG. 6 is a view as in FIG. 5 with separate anchoring elements for the elongate flexible element shown thereon.
Figure 7:
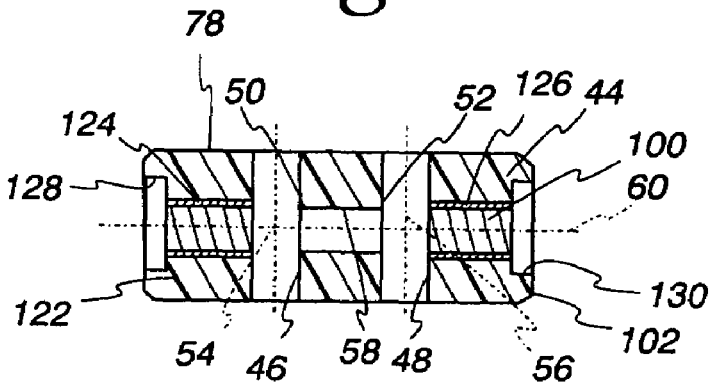
FIG. 7 is a cross-sectional view of the block in FIG. 5.
Figure 9:
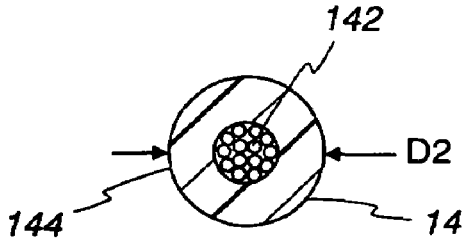
FIG. 9 is an enlarged, cross-sectional view of the elongate flexible element taken along line 9—9 of FIG. 8.
Figure 10:
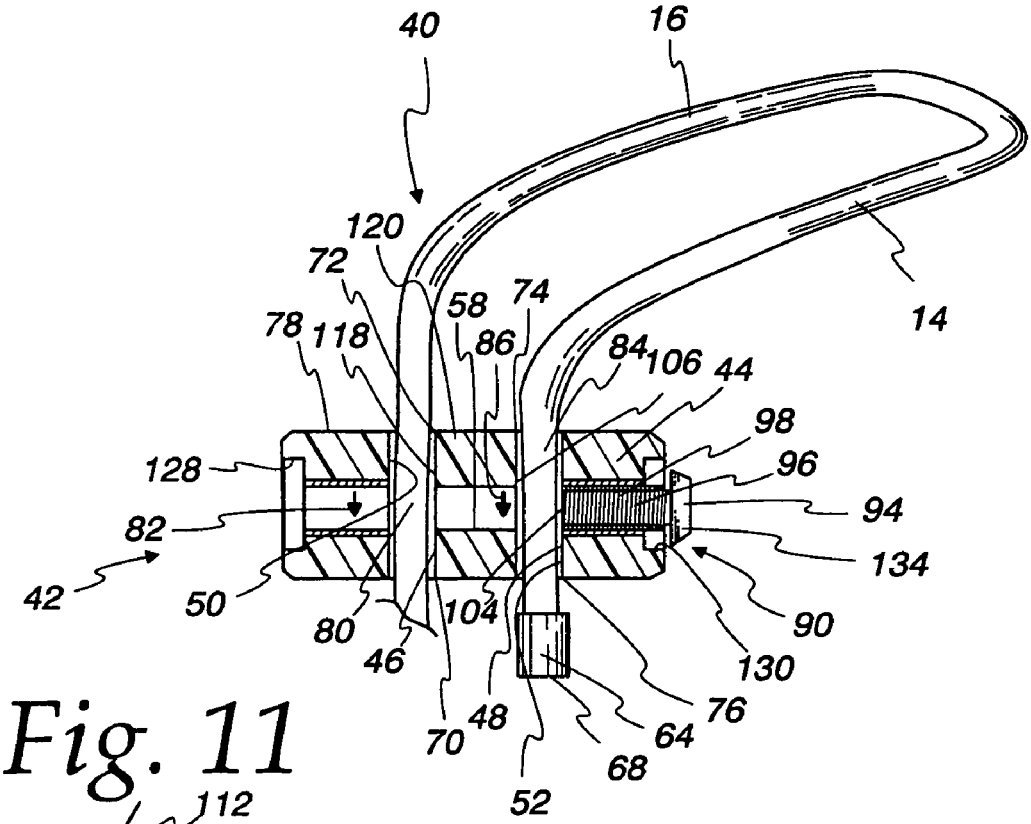
FIG. 10 is a view as in FIG. 7 and with the elongate flexible element connected to the block so as to form a loop.

The anchoring assemblies 88,90 function in the same manner. The exemplary second anchoring element 94 has a body/shank 96 with external threads 98 that mesh with internal threads 100, extending from one axial end 102 of the block 44 fully to the bore 48. The anchoring element 94 can be rotated around the axis 60 to effect movement along the axis 60. The second anchoring element 94 is movable selectively between the position shown in FIG. 6, representing a first state for the anchoring assembly 90, and a second position, as shown in FIGS. 9 and 10, representing a second state for the anchoring assembly 90. With the anchoring assembly 90 in the second state, the free end 104 of the anchoring element 94 is withdrawn substantially fully from the bore 48 so that the bore 48 is unobstructed by the anchoring element 94.

By rotating the second anchoring element 94 in one direction around the axis 60, the second anchoring element 94 can be advanced from right to left in FIG. 10 to bear on the tether portion 84 residing within the bore 48. Continued turning of the second anchoring element 94 in the one direction causes the free end 104 to bear the tether portion 84 against a portion 106 of the surface 52 facing axially toward the advancing, second actuating element 94. Continued advancement of the actuating element 94 firmly bears the tether portion 84 against the surface portion 106 so as to maintain the tether portion 84 against movement relative to the surface portion 106 axially-within the through bore 48.

Figure 11:
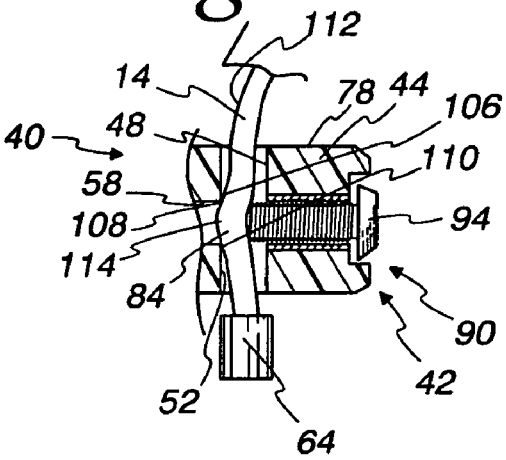
FIG. 11 is an enlarged, fragmentary, cross-sectional, elevation view of a portion of the block and elongate flexible element showing the cooperation between a portion of the elongate flexible element and one of the anchoring elements on the block.

As seen in FIG. 11, relatively sharp edges/corners 108, 110 are defined at the surface 52 at the juncture of the through bores 48,58. The axial pressure of the actuating element 94 on the tether part 84 causes the edges/corners 108,110 to dig into the external surface 112 of the tether 14 to more positively maintain the tether portion 84 against axial movement relative to the surface portion 106.

Additionally, the advanced anchoring element 94 also deforms a part 114 of the tether portion 84 within the bore 52 to deflect into that portion of the through bore 58 that resides between the transverse through bores 46,48. This further fixes the engagement between the tether portion 84 and block 44.

Figure 12:
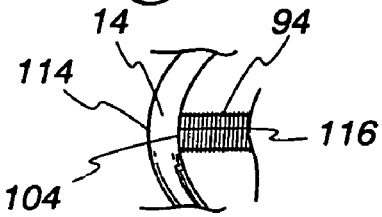
FIG. 12 is an enlarged, fragmentary, elevation view of the connection between the anchoring element and elongate flexible element, as shown in FIG. 11.
Figure 13:
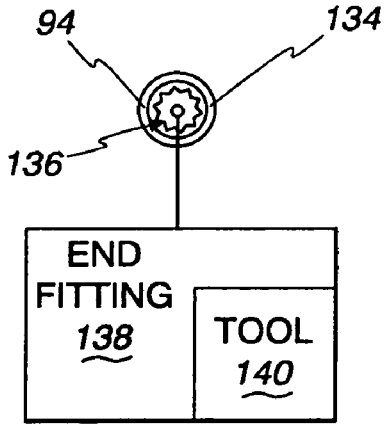
FIG. 13 is an enlarged, partially schematic, elevation view of a head on one of the anchoring elements having a receptacle for an associated tool for turning the head.

Also, as seen particularly in FIGS. 11 and 12, the free end 104 of the anchoring element 94 digs into the tether 14 at a location at 116, diametrically opposite to the part 114, to even more positively secure the tether portion 84 within the bore 48.

While the actuating element 94 has been described to be forcibly driven against the tether portion 84 within the through bore 48, advancing of the actuating element 94 to a lesser extent will reduce the effective diameter of the bore 48 to be less than the effective diameter D for the fitting 64. Thus, without clampingly engaging the tether 14, the actuating element 94 can still be used to block withdrawal of the free end 68 of the tether 14 from the bore 48, oppositely to the direction of arrow 86 in FIG. 10.

The actuating assembly 88 operates in the same manner as the actuating assembly 90, with the actuating element 92 being threadably engaged with the block 44 to be advanced from left to right in FIG. 6, to change the anchoring assembly 88 into a first state, wherein the tether portion 80 is captively borne and maintained against a portion 118 of the surface 50 bounding the through bore and facing oppositely to the surface portion 106. In this embodiment, the oppositely facing surface portions 106,118 are defined on a wall 120 between the through bores 46,48.

The anchoring assemblies 88,90 are thus independently operable to fix the respective tether portions 80,84 within the bores 46,48. While the actuating elements 92,94 are advanced towards and away from each other along a common line, this particular configuration is not required. The inventive concept can be practiced with virtually any independently movable actuating elements that are repositionable to captively bear portions of the tether 14 against the same or different surfaces.

The block 44 can be made from virtually any type of material that adequately resists cutting or breakage. In the embodiment shown, the block 44 has a main body 122 that is molded from a plastic material. Annular, internally threaded, metal inserts 124,126 are embedded in the body 122 to accommodate the anchoring elements 92,94, respectively.

The body 122 of the block 44 has axially undercut receptacles 128,130 to accept enlarged heads 132,134 on the actuating elements 92,94, respectively. The actuating elements 92,94 have the same construction. The exemplary head 134 on the actuating element 94 has a truncated conical shape in which a fitting 136 is formed, to cooperate with an end fitting 138 on a turning tool 140. The turning tool 140 is custom designed with a nonconventional end fitting for security purposes. With the anchoring element 94 tightened so as to place the second anchoring assembly 90 in the first state of FIG. 6, a portion of the head 134 resides in the receptacle 130. This provides a streamlined shape yet permits access to the head 134 when engagement with the turning tool 140 is required. The truncated shape for the head 134 avoids the existence of sharp corners and also serves as a guide to facilitate placement of the tool end fitting 138 into proper engagement with the end fitting 136 on the head 134.

Figure 8:
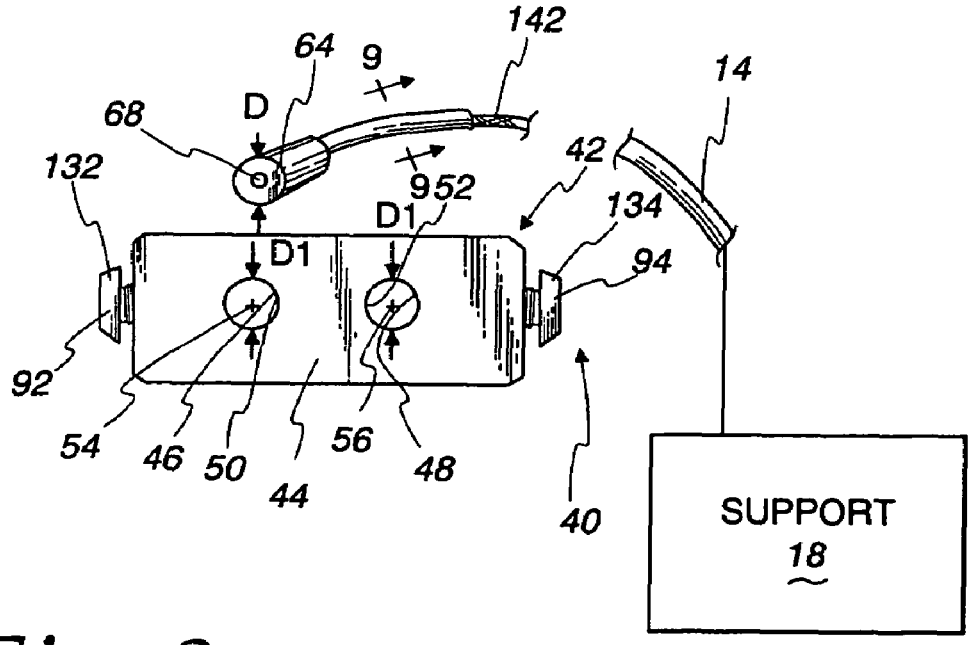
FIG. 8 is an exploded, partially schematic, representation of the security system in FIG. 1 and with spaced anchoring assemblies, including the anchoring elements in FIG. 6, in a state wherein the elongate flexible element can be connected to the block.

As seen in FIGS. 8 and 9, the tether 14 has a braided metal core 142 with a surrounding cover layer 144 that has an outside diameter D2 that is less than the diameter D of the fitting 64. The cover layer 144 may be made of plastic or metal material that is durable, yet preferably will deform under the concentrated force of the surface corners 108,110, as shown in FIG. 12, and under the force of the free end 104 of the anchoring element 94, as shown in FIG. 11.

Figure 14:
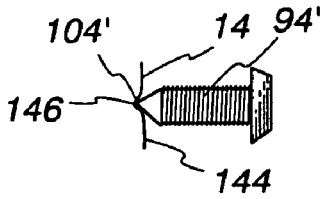
FIG. 14 is a view as in FIG. 11 of a modified form of anchoring element, according to the present invention.

Additional tenacity in the connection between the anchoring elements 92, 94 and the tether 14 can be effected by producing a sharpened point 146 at a free end 104' of an anchoring element 94', as shown in FIG. 14.

Figure 15:
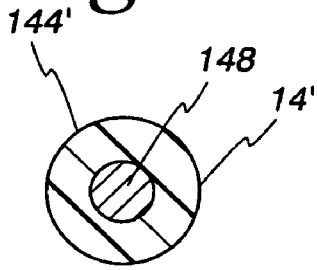
FIG. 15 is a cross-sectional view of a modified form of tether which defines a conductive path to facilitate electrical connection of components.

As shown in FIG. 15, the invention also contemplates a tether 14' with a core 148 that defines a conductive path to facilitate the incorporation into the aforementioned alarm system 20, as described with respect to FIG. 2. An insulating cover layer 144' is provided over the core 148.

Figure 16:
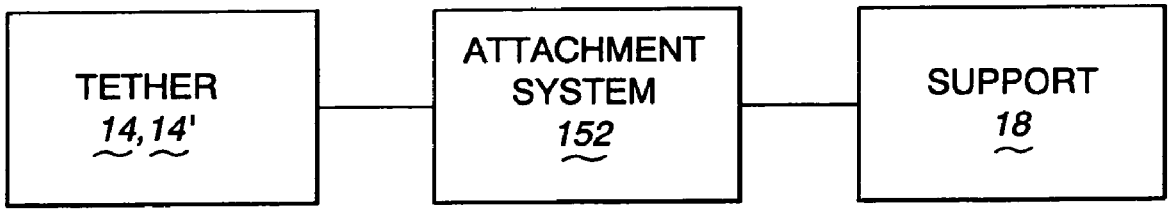
FIG. 16 is a schematic representation of a connection between the elongate flexible element and a support.

As seen in FIG. 16, the mechanical or electromechanical tether 14,14' can be connected to the support 18 through a suitable attachment system 152. The attachment system 152 is intended to generically represent a system for mechanically connecting the tether 14,14' to the support 18 and/or electrically connecting the tether 14,14' to the support 18 so as to incorporate an alarm capability, or other features that may be electrically driven.

With the inventive system 10, the end user can consistently and simply effect connection of the tether 14,14' to an article 12,12'. The tether 14,14' and anchoring system 42 can be shipped in a pre-connected state or as separate components. The anchoring elements 92,94 can be placed by the manufacturer in a retracted position, corresponding to the second state for both of the anchoring assemblies 88,90. At the user's location, the free end 68 of the tether 14,14' can be directed into and through both of the through bores 46,48, as previously described. The free end 68 can be directed through an opening in the particular article 12,12' after the free end 68 is directed through the one through bore 46, but before it is directed into the other through bore 48 to effect a captive arrangement of the particular article 12,12'. Alternatively, the loop/lasso 16 can be preformed and enlarged to be placed over an enlarged portion of an article 12,12', and thereafter restricted into a necked portion to be placed in the operative state. By thereafter tightening the anchoring elements 92,94, the anchoring assemblies 88,90 are placed in their first states and the diameter of the loop/lasso 16 becomes fixed.

While the invention has been described with particular reference to the drawings, it should be understood that various modifications could be made without departing from the spirit and scope of the present invention.

The invention claimed is:

1. A tethering system comprising:

an elongate flexible element having a length; and an anchoring system, the anchoring system comprising a block defining first and second surfaces, the anchoring system further comprising (a) a first anchoring assembly for bearing a first portion of the elongate flexible element against the first surface with the first anchoring assembly in a first state to maintain the first portion of the elongate flexible element substantially fixed against movement relative to the first surface, and (b) a second anchoring assembly for bearing a second portion of the elongate flexible element against the second surface with the second anchoring assembly in a first state to maintain the second portion of the elongate flexible element substantially fixed against movement relative to the second surface, the first anchoring assembly changeable selectively between its first state and a second state wherein the first portion of the elongate flexible element can move relative to the first surface, the second anchoring assembly changeable selectively between its first state and a second state wherein the second portion of the elongate flexible element can move relative to the second surface, the elongate flexible element formable into a loop with a diameter between the first and second portions, the loop maintainable in a selected diameter with the first and second anchoring assemblies in their first states, the diameter of the loop variable by placing the first anchoring assembly in its second state and moving the first portion of the elongate flexible element relative to the first surface to produce a changed diameter for the loop, the first anchoring assembly changeable from its second state into its first state to thereby maintain the changed diameter for the loop, wherein the block has first and second openings bounded respectively by the first and second surfaces, wherein there is a bore through the block that intersects each of the first and second openings, the bore having first and second ends, wherein the first anchoring assembly comprises a first anchoring element that is threadably connected to the block and extended through the first end of the bore in a first direction to force the first portion of the elongate flexible element in the first opening into a portion of the bore that resides between the first and second openings without extending fully through the elongate flexible element, wherein the second anchoring assembly comprises a second anchoring element that is threadably connected to the block and extended through the second end of the bore opposite to the first direction to force the second portion of the elongate flexible element in the second opening into the portion of the bore without extending fully through the elongate flexible element.

2. The tethering system according to claim 1 wherein the first and second openings are fully spaced, each from the other.

3. The tethering system according to claim 1 wherein the first and second openings are defined by substantially parallel bores through the block.

4. The tethering system according to claim 1 wherein the first surface comprises a sharp edge against which the first portion of the elongate flexible element is borne by the first anchoring assembly.

5. The tethering system according to claim 4 wherein the first portion of the elongate flexible element has an outer surface into which the sharp edge digs with the first anchoring assembly in its first state.

6. The tethering system according to claim 1 wherein the first anchoring element is movable selectively towards and away from the first surface to thereby change the first anchoring assembly between its first and second states.

7. The tethering system according to claim 6 wherein the first anchoring element is turnable around a first axis selectively in first and second opposite directions to thereby move the first anchoring element towards and away from the first surface.

8. The tethering system according to claim 7 wherein the first anchoring element has a head that is engageable by a tool through which the first anchoring element can be turned around the first axis.

9. The tethering system according to claim 8 wherein the head has a receptacle for cooperating with a custom designed turning tool.

10. The tethering system according to claim 6 wherein the second anchoring element is movable selectively towards and away from the second surface to thereby change the second anchoring assembly between its first and second states.

11. The tethering system according to claim 1 wherein the block comprises a wall, the first surface is defined by the wall and faces in a first direction and the second surface is defined by the wall and faces oppositely to the first direction.

12. The tethering system according to claim 1 wherein the first and second openings are defined by spaced first and second bores through the block, the elongate flexible element has a free end and the free end can be directed fully through each of the first and second through bores.

13. The tethering system according to claim 12 wherein the first bore has a first diameter, the free end of the elongate flexible element has an enlargement thereon with a second diameter that is less than the first diameter, and with the first anchoring assembly in its first state, the diameter of the first bore is effectively reduced to less than the second diameter.

14. The tethering system according to claim 1 in combination with a support to which a part of the elongate flexible element spaced from the loop is attached.

15. The tethering system according to claim 14 wherein the elongate flexible element comprises a hardened metal core.

16. The tethering system according to claim 14 further comprising an article having a portion around which the loop extends and an alarm system for producing a detectable signal in the event that at least one of (a) the article is separated from the loop, (b) the elongate flexible element is separated from the support and (c) the elongate flexible element is severed.

17. The tethering system according to claim 8 wherein the block has a recess for accepting at least a portion of the head on the first anchoring element as an incident of the first anchoring element being turned around the first axis.

18. The tethering system according to claim 8 wherein the head on the first anchoring element has a free end and the head has a truncated conical shape with a diameter that increases away from the free end of the head.

19. The tethering system according to claim 1 wherein the block comprises a plastic material.

20. The tethering system according to claim 1 wherein the block has a cylindrical shape.

21. The tethering system according to claim 1 wherein the bore has a first axis, the first and second openings comprise bores respectively with second and third substantially parallel axes, and the first axis intersects each of the second and third axes.

22. A tethering system comprising:

an elongate flexible element having a length and an enlargement at or adjacent a free end thereof; and an anchoring system, the anchoring system comprising a block with first and second surfaces, defined respectively by first and second bores, the elongate flexible element extended into and through the first bore and into the second bore to define a loop, the anchoring system further comprising (a) a first anchoring assembly for bearing a first portion of the elongate flexible element against the first surface with the first anchoring assembly in a first state to maintain the first portion of the elongate flexible element substantially fixed against movement relative to the first surface, and (b) a second anchoring assembly having a first state wherein the enlargement is blocked so that the enlargement cannot be withdrawn from the second bore, the first anchoring assembly changeable selectively between its first state and a second state wherein the first portion of the elongate flexible element can move relative to the first surface, the second anchoring assembly changeable selectively between its first state and a second state wherein the enlargement can be withdrawn from the second bore, the first anchoring assembly comprising a first anchoring element that is threadably connected to the block and extended into the block in a first direction to be changed from the second state into the first state, the second anchoring assembly comprising a second anchoring element that is threadably connected to the block and extended into the block in a second direction substantially oppositely to the first direction to be changed from the second state into the first state.

23. The tethering system according to claim 22 wherein the second bore has a circular cross-sectional shape with a first diameter and the enlargement has a second diameter that is less than the first diameter.

24. The tethering system according to claim 23 wherein the elongate flexible element comprises a cable with a substantially uniform diameter that is less than the first and second diameters.

* * * * *